US005860617A

United States Patent [19]

Bolza-Schünemann

[11] Patent Number: 5,860,617

[45] Date of Patent: Jan. 19, 1999

[54] DEVICE FOR UNWINDING A WEB OF MATERIAL

[75] Inventor: Claus August Bolza-Schünemann, Würzburg, Germany

[73] Assignee: Koenig & Bauer-Albert Aktiengesellschaft, Wurzburg, Germany

[21] Appl. No.: 971,734

[22] Filed: Nov. 17, 1997

Related U.S. Application Data

[63] Continuation of Ser. No. 544,873, Oct. 18, 1995, abandoned.

[30] Foreign Application Priority Data

Oct. 18, 1994 [DE] Germany ..... 44 37 147.0

[51] Int. Cl.[6] ..... B65H 16/10; B65H 16/06

[52] U.S. Cl. ..... 242/596.5; 242/564.5

[58] Field of Search ..... 242/564.5, 541, 242/541.1, 393, 352.3, 596.5

[56] References Cited

U.S. PATENT DOCUMENTS

| | | | |
|---|---|---|---|
| 1,788,648 | 1/1931 | Wood | 242/541 |
| 1,883,222 | 10/1932 | Wood | 242/541 |
| 3,019,995 | 2/1962 | Eckert et al. | 242/393 X |
| 3,851,834 | 12/1974 | White et al. | 242/68.3 |
| 4,676,448 | 6/1987 | Kofler | 242/67.1 R |

FOREIGN PATENT DOCUMENTS

| | | |
|---|---|---|
| 35 21 582 | 6/1987 | Germany . |
| 42 34 344 | 5/1993 | Germany . |

*Primary Examiner*—John Q. Nguyen
*Attorney, Agent, or Firm*—Jones, Tullar & Cooper, P.C.

[57] ABSTRACT

A device for unwinding a web of material which is wound in a roll on a winding core is utilized in a roll changer of a printing press. An inner shaft carries a clamping cone and an outer, coaxial shaft carries a torque transmitting element. These two shafts are slidable axially independently of each other and can operate in concert to rapidly stop a rotating wound roll of material having a large mass. Large torques can be transmitted to the wound roll without causing damage to the wound material.

7 Claims, 2 Drawing Sheets

DEVICE FOR UNWINDING A WEB OF MATERIAL

This application is a continuation of application Ser. No. 08/544,873, filed Oct. 18, 1995, abandoned.

FIELD OF THE INVENTION

The present invention is directed generally to a device for unwinding a web of material. More particularly, the present invention is directed to a device for unwinding a paper web wound in the shape of a wound roll. Most specifically, the present invention is directed to a device for unwinding a paper web in a wound roll changer of a rotary printing press. The paper web, which is wound in the shape of a wound roll on a winding core, is supported and rotated by expandable, rotatable clamping cones that engage the ends of the winding core. These clamping cones transmit torque to the winding core and thus to the wound roll. At least one torque transmitting element is also provided and is capable of rotating, at least part of the time, in synchronism with the clamping cones. This torque transmitting element is engageable with an end face of the wound roll and can be moved axially into and out of engagement with the end face of the wound roll independently of axial movement of the clamping cones.

DESCRIPTION OF THE PRIOR ART

In the field of web-fed rotary printing presses, the paper web is typically supplied to the press from a wound roll that is wound about a central, hollow winding core. The winding core supports the wound roll of paper web material. The two ends of the winding core are engaged by expandable cones so that the winding core will be supported and can be rotated. A positive drive arrangement is usually required to rotate the wound roll of paper web at the proper press speed The wound roll must also be able to be stopped in case of an emergency which might require the rapid deceleration of the rapidly rotating wound roll.

One prior art device that has been used for clamping of winding cores of wound rolls in a web-fed rotary press is shown in German Patent Publication DE 35 21 582 C2. In this prior device, the rotatable clamping cones are provided with winding core clamping elements which are in the shape of segments of tubes. These clamping elements expand radially and accomplish the clamping of the winding core on the clamping cones. A limitation of this device is the relatively small contact area between the expandable clamping elements and the interior surface of the winding core. This small contact area makes it impossible to transfer the large mass moment of inertia when one of the wound rolls, which is of the large diameter and great width that is customary today, is to have its speed of rotation changed. This small contact area is not sufficient to transfer a change in speed of the clamping cones to the winding core without significant slippage.

Another prior art paper web wound roll support and changing device is shown in German Patent Publication DE 42 34 344 A1. This prior art device is usable with a production machine for changing rolls of web-shaped material. A winding core of the wound roll is received in spindles. Suction cups, that are positioned on a disk, act on the end faces of the wound roll. These suction cups or the disk are connected to a spindle in a torsion resistant manner. This prior art device can cause damage to the edges of the paper web material wound on the roll due to the action of the suction cups. This possibility of web edge damage is particularly great when the diameter of the paper web roll is less than the diameter of the disk that carries the suction cups.

It will be seen that a need exists for a device for use in the unwinding of a web of material from a roll that overcomes the limitations of the prior art. The device for unwinding of a web of material in accordance with the present invention provides such a device and is a significant improvement over the prior art.

SUMMARY OF THE INVENTION

It is an object of the present invention to provide a device for unwinding a web of material.

Another object of the present invention is to provide a device for unwinding a paper web wound in a web roll.

A further object of the present invention is to provide a device for unwinding a paper web roll in a wound roll changer of a rotary printing press.

Still another object of the present invention is to provide a device for unwinding a web roll which utilizes torque transmitting elements that act on the end faces of a roll.

Yet a further object of the present invention is to provide a device for unwinding a web of material which does not damage the web of material even if the diameter of the wound roll becomes less than the diameter of the torque transmitting elements.

As will be discussed in detail in the description of the preferred embodiment which is presented subsequently, the device for unwinding a web of material, such as a paper web, in a roll changer of a rotary web-fed printing press utilizes rotatable clamping cones to engage the ends of a winding core on which the web of material has been wound in the shape of a wound roll. The rotatable clamping cones are engageable with the ends of the winding core and transfer torque to it. At least one torque transmitting element, which may be in the form of a disk having a friction surface, is rotatable synchronously with the clamping cones and is shiftable axially independently of the clamping cones. The friction surface of the torque transmitting element can be moved into and out of engagement with the end face of the paper web roll to quickly transfer torque to the wound roll of web material.

A significant advantage of the present invention over the prior art devices is its ability to transfer torque from the web unwinding machine to the wound roll quickly and completely without slippage. Damage to the edges of the paper web wound on the roll is thus prevented. Because the present device can transfer large amounts of torque quickly, it is possible to brake the large web rolls which are presently being used, and which have very large moments of inertia, in a very short time. The time required to stop a large wound web roll during a rapid or emergency press stoppage situation is shortened considerably by use of the subject invention. This results in less paper wastage and significantly increases the dependability of the machine.

Another particular advantage of the device for unwinding a web of material in accordance with the present invention is the ability of the torque transfer or transmitting elements to shift axially independently of the winding core clamping cones. These torque transfer elements can be brought into engagement with the end faces of the roll when their presence is needed, and can be retracted away from the wound roll when not required. Damage to the edges of the paper web material is thus prevented, even when the diameter of the wound roll becomes less than the diameter of the torque transfer elements.

It will thus be seen that the device for unwinding a web of material in accordance with the present invention overcomes the limitations of the prior art. It is a substantial advance in the art.

BRIEF DESCRIPTION OF THE DRAWINGS

While the novel features of the device for unwinding a web of material in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
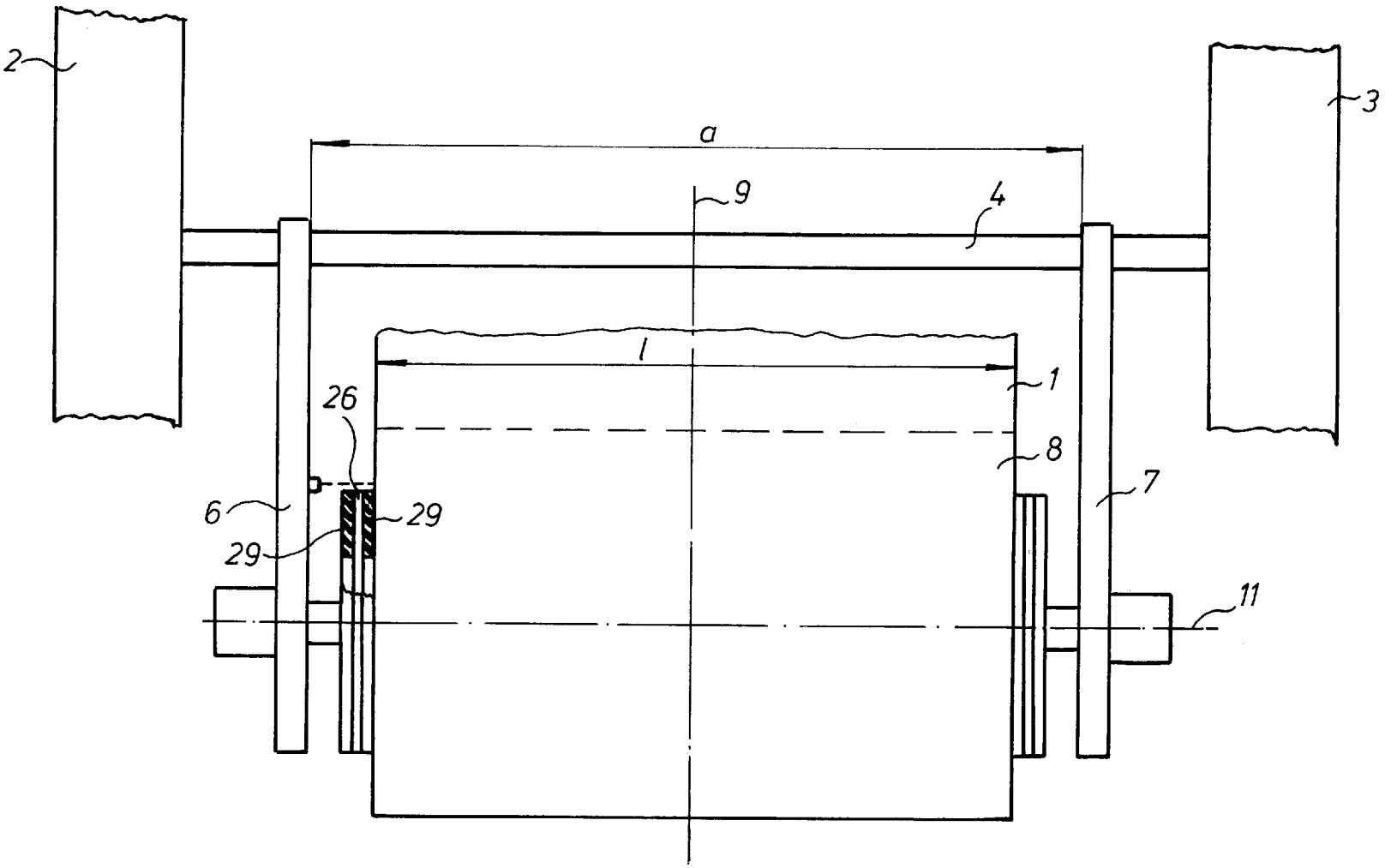
FIG. 1 is a schematic top plan view of a portion of a wound roll changer showing a device for unwinding a web of material, in accordance with the present invention.

Referring initially to FIG. 1, there may be seen a preferred embodiment of a device for unwinding a web of material in accordance with the present invention. The web of material 1 which is to be unwound is typically a paper web that will be used in a rotary web-fed printing press. The material web unwinding device is integrated into the wound roll changer of the press.

Figure 2:
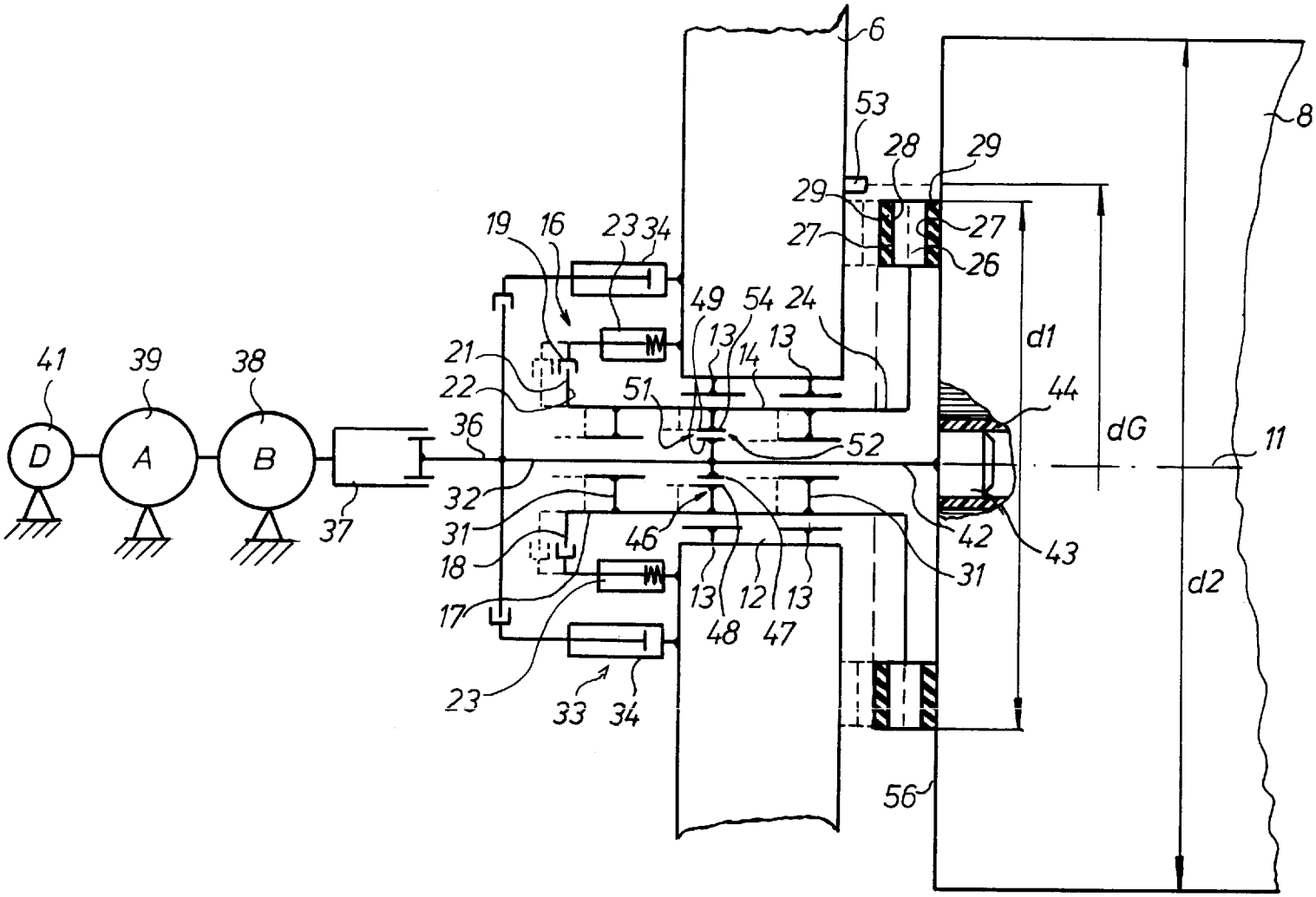
FIG. 2 is a schematic side elevation view, partly in section of the material web unwinding device of the present invention.

A shaft 4, on which left and right support arms 6 and 7 are fastened, is seated in side frames 2 and 3 of a wound roll changer of a rotary printing press, as seen in FIG. 2. These support arms 6 and 7 are disposed on the shaft 4 so as to be axially displaceable, but are fixed against relative rotation. The support arms 6 and 7 can be shifted axially in order to adapt a distance "a" between the support arms, of, for example 2.5 m, to a width "b", of, for example 2 m, of the web 1 of material, typically a wound roll 8, as well as to fix a position of the wound roll 8 with respect to a center axis 9 of the rotary printing press. The shaft 4 can be pivotable by means of conventional drive assemblies, not shown, in order to bring the wound roll 8 into the various positions which are required for changing the wound roll.

Turning now primarily to FIG. 2, it will be seen that the left support arm 6 has a first seat, which may be, for example, a needle bearing 13, situated in a bore 12 and placed concentrically with respect to an axis of rotation 11 of the wound roll 8. This bearing 13 receives a tube-shaped hollow shaft 14 so that shaft 14 is supported exteriorly by bearing 13 in a rotatably and axially displaceable manner.

Shaft adjusting devices, generally at 16, engage this hollow shaft 14 and can displace the hollow shaft 14 axially, even during a simultaneous rotation of the hollow shaft 14. In the present embodiment, an end 17 of the hollow shaft 14, that is facing away from the wound roll 8, is provided with a ring-shaped collar 18, which rotates with shaft 14 and which extends perpendicularly with respect to the axis of rotation 11. This collar 1 is enclosed by a non-rotating ring 19, which is fork-shaped in section, or by one or several fork segments. It is possible to position axial bearings between the collar 18 and the fork-shaped ring 19, for example on both sides 21 and 22 of the collar 18. It is, for example, also possible to form a fork segment 19 in such a way that cam rollers, whose pins are connected parallel via a coupling, act on both sides of the collar 18. One or more hollow shaft 14 position shifting drives are disposed parallel to and concentrically with the axis of rotation 11. In the preferred embodiment, singly acting, spring biased pneumatic cylinders 23 are used as these positioning drives for hollow shaft 14. Other known positioning drives, for example hydraulic cylinders, spindle drives, linear drives, and the like are also usable instead of the single acting pneumatic cylinders 23.

One or more torque transfer elements 26, which in the present embodiment is a ring-shaped disk 26, are placed concentrically with respect to the axis of rotation 11, and are fastened on an end 24 of the hollow shaft 14 which is located adjacent the end face of the wound roll 8. On its two opposing flat sides 27 and 28, this disk 26 is provided with friction linings 29, so that the friction linings 29 are connected in a torsion-proof manner with the hollow shaft 14. These friction linings 29 can be made as ring-shaped disks with an exterior diameter "d1", of, for example 700 mm, and which are simply fastened by material contact with the support disk 26 of the hollow shaft 14. Alternatively, friction linings 29 which are in the form of segments of a circle, or which have other forms, are also possible for use in the present invention. Caoutchouc or polyurethane, for example, are suitable as the material for the friction linings 29.

The disk 26 formed or positioned on the inner end 24 of the hollow shaft 14 can also be embodied as a narrow disk which is then connected with the hollow shaft 14 by means of spokes, for example, or of individual plates, for example, provided with friction linings 29 and fastened on support arms. These support arms can be made to be pivotable in such a way that the plates can be placed against the end face of the wound roll or can be moved away from it.

A second seat or bearing, for example a needle bearing 31, is fastened interiorly in the hollow shaft 14 and receives a solid shaft 32 which is rotatable and which is aligned on the axis of rotation 11 and which is also axially displaceable. The solid shaft 32 is provided with an adjusting device, generally at 33, which can axially displace the solid shaft 32, even during rotation of the hollow shaft 14. This adjusting device 33 can be structured in a manner similar to the adjusting device 16 for the hollow shaft 14, and can be, for example, pneumatic cylinders 34 An outer end 36 of the shaft 32 facing away from the wound roll 8, is connected by means of a clutch 37, which transfers torque and which compensates at least for axial offset of the shaft 32, for example by keying, with a braking device 38, which may be, for example, a disk brake, with a drive 39, which may be, for example, a three-phase a.c. motor, and with an rpm transmitter 41, which may be, for example, an incremental transmitter.

An inner end 42 of the shaft 32, which is facing the wound roll 8, is provided with a clamping cone 43, that has a generally known structure for receiving a tube-shaped winding core 44 of the wound roll 8 This clamping cone 43 can have, for example, pneumatically operated, expanding cheeks. The generally conventional details of the clamping cone as well as its associated actuating devices are not depicted in the drawings. They are generally well known and operate in their conventional manner to engage an interior surface of the winding core 44 and to transmit rotation of the solid shaft 32 to the winding cores 44 and thus to the wound roll 8 of the material web 1.

The hollow outer shaft 14 and the solid inner shaft 32 are connectable to each other by means of an actuable, torsion-proof clutch or shaft coupling 46. In the present embodiment, this clutch or shaft coupling 46 is embodied as a slidable splined shaft connection. An axially extending area of the inner shaft 32 is profiled as a splined inner shaft section 47, and a splined bore hub 48 is rigidly fastened within the hollow shaft 14. On both of their ends the respective keys or splines 49 of the splined shaft 47 and of the splined bore hub 48 are embodied to be tapered, and are, for example, arrow-shaped in the axial direction. It is also possible to use known radially acting friction clutches.

The right support arm 7 is structured in a mirror-reversed manner with respect to the left support arm 6. However, the drive 39 and the rpm transmitter 41 can be omitted from the right support arm. A sensor 53 is attached on the support arm 6, and may be, for example, a photoelectric reflection scanner. This sensor 53 is used for detecting a defined threshold diameter "dG", of, for example, 800 mm, of the wound roll 8.

The operation of the device for unwinding a web of material in accordance with the present invention, will now be discussed with reference to the left support arm 6 as is depicted in FIG. 2. It will be understood that the right support arm 7 functions in the same fashion but in a mirror-reversed manner.

The solid inner shaft 32 with its clamping cone 43' and the hollow outer shaft 14 with its disk 26 provided with friction linings 29 are initially placed in their disengaged positions in which they are remote from the wound roll; in which position, the pneumatic cylinders 34 are extended. The wound roll 8 is placed between the support arms 6 and 7 in such a way that the winding core 44 is approximately flush with the inner end of the clamping cone 43. The clamping cone 43 is then pushed into the winding core 44 by retracting the pneumatic cylinders 34 of the adjusting device 33. The cheeks of the clamping cone 43 are then expanded in a conventional manner. In this way, the winding core 44 and the wound roll 8 are frictionally or interlockingly connected with the clamping cone 43. Following this, the rpm of the shaft 32 is detected by means of the rpm transmitter 41 and the threshold diameter dG of the wound roll 8 is detected by means of the sensor 53. If the shaft 32, or the wound roll 8, is stationary and if an actual diameter d2 of the wound roll 8 at least corresponds to the threshold diameter dG, a clearance for the axial displacement of the hollow shaft 14 in the direction of the wound roll 8 is given. The hollow shaft 14 is then displaced in the direction toward the wound roll 8 by charging the pneumatic cylinders 23. The splined shaft 47 engages the splined bore hub 48 shortly after the release of the friction linings 29 from their disengaged position in contact with the support arms 6 and 7. If the keys 49 and grooves 54 of the splined shaft 47 are not directly aligned with the spline bore hub 48, a slight rotation of the hollow shaft 14 is generated by means of the tapering ends 51 and 52 of the keys 49, so that, with continued axial movement of the hollow shaft 14, the splined shaft 47 and the splined bore hub 48, will slide into each other. The hollow outer shaft 14 and the solid inner shaft 32 are thus connected with each other in a torsion-proof manner and therefore will rotate synchronously.

The hollow shaft 14 is displaced axially by the pneumatic cylinders 23 far enough so that the friction linings 29 are pressed against an end face 56 of the wound roll 8. There is now a frictional connection, which can transfer torque, between the friction linings 29, that are part of the hollow outer shaft 14, and the wound roll 8.

Following a roll changing operation, the wound roll 8 is being rotated by the drive motor 38, through the solid inner shaft 32 so that the web 1 of material is being unwound at a uniform circumferential speed and at a constant production speed. The actual diameter "d2" of the wound roll 8 will reduce and the rpm of the motor will increase. This is performed by means of the rpm-controlled drive 39. If now a rapid stop of the wound roll 8 is required, a braking moment is transmitted to the shaft 32 by the brake device 38. As long as the friction linings 29 cooperate with the end surface 56 of the wound roll 8, i.e. as long as the diameter "d2" of the wound roll 8 is greater than the threshold diameter "dG", the brake moment is split at the clutch or shaft coupling 46. The clutch or shaft coupling 46 transmits a portion of the braking moment to the hollow shaft 14, which braking moment is, in turn, transmitted to the wound roll 8 by means of the friction linings 29. In this way, an overload on the winding core 44 will not be possible. If no rapid stop is required, the pneumatic cylinders 23 are vented in response to a signal from the sensor 53 when the threshold diameter "dg" of the wound roll 8 has been reached, and the hollow shaft 14 is pushed away from the wound roll 8 by the spring force. In the process, the clutch or shaft coupling 46 disconnects the shaft 32 from the retracting hollow shaft 14 before the friction linings 29 reach the support arm 6, so that the hollow shaft 14 is rendered freely rotatable. The friction linings 29 are pressed against the support arm 6 by further displacement of the hollow shaft 14. The rotating movement of the hollow shaft 14 is braked by the engagement of the friction lining 29 with the inner surface of the left support arm 6 and this stops the rotation of the hollow outer shaft 14. Once the diameter of the wound roll 8 has been reduced below the threshold diameter "dg", the mass of the wound roll 8 will be sufficiently low that a rapid stop of the wound roll 8 can be accomplished by a braking action from the braking device 38 which acts only on the winding core 44 through the clamping cones 43.

While a preferred embodiment of a device for unwinding a web of material in accordance with the present invention has been set forth fully and completely hereinabove, it will be apparent to one is of skill in the art that a number of changes in, for example, the overall size of the wound roll, the specific structure of the clamping cones, the drive means for the support shaft for the left and right arms and the like may be made without departing from the true spirit and scope of the present invention which is accordingly to be limited only by the following claims.

What is claimed is:

1. A device for unwinding a web of material wound in the shape of a wound roll on a winding core in a wound roll changer of a rotary printing press comprising:

at least one clamping cone;

a rotatable inner shaft, said rotatable inner shaft being rotatable about an axis of rotation, said clamping cone being supported at an inner end of said rotatable inner shaft, said clamping cone being insertable into an end of a winding core of a wound roll to support the wound roll and to engage and rotate the winding core and the wound roll;

means for shifting said rotatable inner shaft axially along said rotatable inner shaft axis of rotation to move said clamping cone along said axis of rotation into and out of the end of the winding core;

a rotatable hollow outer shaft concentric with said rotatable inner shaft;

means in said rotatable hollow outer shaft for supporting said rotatable inner shaft for rotational and axial movement with respect to said hollow outer shaft;

at least one torque transmitting element secured to a first axial end of said rotatable hollow outer shaft, said torque transmitting element having a friction lining which is engageable with an end face of the wound roll to apply a torque force to the wound roll;

means on said rotatable inner shaft, and within said hollow outer shaft to selectively engage an interior portion of said hollow outer shaft and to rotate said rotatable hollow outer shaft and said torque transmitting element;

means to axially shift said rotatable hollow outer shaft and said torque transmitting element independently of said rotatable inner shaft to move said torque transmitting element into and out of engagement with the end face of the wound roll; and means for sensing a diameter of the wound roll on the winding core and for axially shifting said torque transmitting element out of engagement with the end face of the wound roll when the diameter of the wound roll falls below a threshold value.

2. The device in accordance with claim 1 wherein said torque transmitting element is selectively rotatable with said clamping cone by means of an actuable clutch.

3. The device of claim 2 wherein said actuable clutch is a splined area on said rotatable inner shaft and a splined bore hub on said rotatable hollow outer shaft.

4. The device in accordance with claim 1 wherein said torque transmitting element is a ring shaped disk that is concentric with said axis of rotation.

5. The device of claim 1 wherein said torque transmitting element has a flat side provided with said friction lining.

6. A device for unwinding a web of material from a roll of material wound on a winding core in a web fed rotary printing machine comprising:

first and second clamping cones;

first and second rotatable inner shafts, said first and second rotatable inner shafts being rotatable about an axis of rotation, said first and second clamping cones being supported at inner ends of said first and second rotatable inner shafts, respectively;

means for shifting said first and second rotatable inner shafts axially along said axis of rotation and for inserting said first and second clamping cones axially into respective first and second ends of a winding core to support the winding core and to engage and rotate the winding core and a wound roll of material on the winding core;

first and second rotatable hollow outer shafts concentric with and selectively engageable and rotatable with said first and second rotatable inner shafts;

means in said first and second rotatable hollow outer shafts for supporting said respective first and second rotatable inner shafts for rotational and axial movement with respect to said first and second hollow outer shafts;

first and second torque transmitting elements respectively secured to first axial ends of said first and second rotatable hollow outer shafts, said first and second torque transmitting elements each having a friction lining, said first and second friction linings being engageable with first and second end faces of the wound roll of material to apply a torque force to the wound roll;

means on said first and second rotatable inner shafts, and within said hollow outer shafts for selectively engaging an interior portion of each of said hollow outer shafts and rotating said first and second hollow outer shafts and said first and second torque transmitting elements; and means to axially shift said first and second rotatable hollow outer shafts independently of said first and second rotatable inner shafts and said first and second clamping cones during rotation of both said rotatable inner shafts and said rotatable hollow outer shafts.

7. A device for unwinding a web of material wound in the shape of a wound roll on a winding core in a wound roll changer of a rotary printing press comprising:

at least one axially shiftable clamping cone rotatable about an axis of rotation and engageable with an end of a winding core of a wound roll to rotate the winding core and the wound roll;

at least one torque transmitting element, said torque transmitting element being selectably rotatable synchronously with said clamping cone, said torque transmitting element being engageable with an end face of the wound roll, said torque transmitting element having a flat face situated away from said end face of the wound roll, said flat face having a friction lining;

a roll changer including a support arm, said flat face engaging said support arm when said torque transmitting element is situated out of engagement with said end face; and means for axially shifting said torque transmitting element into and out of engagement with said end face of the wound roll independently of axial movement of said clamping cone.

* * * * *